US012508498B1

(12) United States Patent
Liu

(10) Patent No.: US 12,508,498 B1
(45) Date of Patent: Dec. 30, 2025

(54) JIGSAW PUZZLE TABLE

(71) Applicant: Tian

(72) Inventor: Yu Liu, Heping County (CN)

( * ) Notice: Subject to any disclaimer, the term of this patent is extended or adjusted under 35 U.S.C. 154(b) by 0 days.

(21) Appl. No.: 19/204,361

(22) Filed: May 9, 2025

(51) Int. Cl.
*A63F 9/10* (2006.01)
*A47B 13/08* (2006.01)
*A47B 37/00* (2006.01)

(52) U.S. Cl.
CPC ..... *A63F 9/1044* (2013.01); *A47B 13/088* (2013.01); *A47B 37/00* (2013.01)

(58) Field of Classification Search
CPC ..... A63F 9/1044; A47B 13/088; A47B 37/00; A47B 87/00; A47B 87/002
USPC ..... 108/64, 65
See application file for complete search history.

(56) References Cited

U.S. PATENT DOCUMENTS 2,101,573 A * 12/1937 Cramer ..... A47B 3/12 108/129
2,447,743 A * 8/1948 Dieter ..... A47B 25/003 473/475
2,596,663 A * 5/1952 Duffy ..... A47B 87/002 108/69
2,783,107 A * 2/1957 Gacht ..... A47B 87/002 108/146
2,836,475 A * 5/1958 Sapp ..... A47B 87/002 108/64
4,150,630 A * 4/1979 Pokorny ..... A47B 91/16 108/90
4,165,908 A * 8/1979 Cooper ..... F16B 12/28 403/388
4,740,033 A * 4/1988 Lee ..... A47C 4/02 297/283.1
5,528,996 A * 6/1996 Edwards ..... A47B 13/021 248/188
5,595,126 A * 1/1997 Yeh ..... A47B 87/002 108/65
6,032,590 A * 3/2000 Chen ..... A47B 3/12 403/381
6,085,668 A * 7/2000 Kanki ..... F16B 12/125 108/65
8,584,598 B2 * 11/2013 Derkoski ..... A47B 3/12 108/14
8,919,263 B2 * 12/2014 Jeong ..... A47B 91/00 52/263
10,939,676 B1 * 3/2021 Harter ..... E04G 5/10
10,980,338 B1 * 4/2021 Marion ..... A47B 13/081
11,890,551 B2 2/2024 Che
(Continued)

*Primary Examiner* — Jose V Chen
(74) *Attorney, Agent, or Firm* — Che-Yang Chen; Law Office of Michael Chen

(57) ABSTRACT

A jigsaw puzzle table includes three groups of table boards, each group of the table boards having an upper table board and a lower table board; the left, right and bottom sides of the upper table boards are all provided with latch grooves, the left, right and upper sides of the lower table boards are all provided with latch grooves, a latch is disposed in every two opposite latch grooves, a limiting block is fixedly connected in each latch groove, two limiting grooves are provided on the top of each latch, a plurality of concave grooves are evenly provided on the bottom of each latch, two support frames are installed on the bottom of each group of the upper table board and the lower table board, and each support frame is provided in an irregular quadrilateral structure.

5 Claims, 9 Drawing Sheets

(56) References Cited

U.S. PATENT DOCUMENTS

| | | | | |
|---|---|---|---|---|
| 2012/0222588 | A1* | 9/2012 | Davis | E04H 3/28 108/64 |
| 2014/0123882 | A1* | 5/2014 | Kassanoff | A47B 87/002 108/26 |
| 2014/0331903 | A1* | 11/2014 | Massimini | A47B 13/088 108/64 |
| 2021/0215181 | A1* | 7/2021 | Maager | A47B 47/042 |
| 2021/0378400 | A1* | 12/2021 | Egger | F16M 11/18 |
| 2022/0142362 | A1* | 5/2022 | Saenz | A47B 39/12 |
| 2022/0258040 | A1* | 8/2022 | De Cianni | A63F 9/1044 |
| 2025/0083032 | A1* | 3/2025 | Zhang | F16M 11/08 |

* cited by examiner

JIGSAW PUZZLE TABLE

FIELD OF THE INVENTION

The invention relates to the technical field of educational game supplies, and in particular to a jigsaw puzzle table.

BACKGROUND OF THE INVENTION

As an educational game, jigsaw puzzle plays an important role in the intellectual development of children, which is also very popular among adults due to its playability. When playing jigsaw puzzle games, players need to carefully identify the puzzle pieces to find similar points for splicing. In order to enable players to better perform jigsaw puzzle games, jigsaw puzzle tables came into being. However, traditional jigsaw puzzle tables are all provided in one-piece with relatively large specifications, which are inconvenient to carry and affect the user experience of the jigsaw puzzle.

Therefore, the present invention provides a jigsaw puzzle table to solve the above-mentioned problems.

SUMMARY OF THE DISCLOSURE

In view of the above situation, the present invention provides a jigsaw puzzle table, which effectively solves the problems that the traditional jigsaw puzzle tables are integrally formed with relatively large specifications, and are inconvenient to carry.

In order to achieve the above objects, the present invention provides the following technical solutions:

A jigsaw puzzle table, comprising three groups of table boards, each group of the table boards includes an upper table board and a lower table board; the left, right and bottom sides of the upper table boards are all provided with latch grooves, the left, right and upper sides of the lower table boards are all provided with latch grooves, a latch is disposed in every two opposite latch grooves, a limiting block is fixedly connected in each latch groove, two limiting grooves are provided on the top of each latch, a plurality of concave grooves are evenly provided on the bottom of each latch, two support frames are installed on the bottom of each group of the upper table board and the lower table board, and each support frame is provided in an irregular quadrilateral structure.

Preferably, the support frame further comprising four support rods, the four support rods are connected end-to-end in sequence to form an irregular quadrilateral frame, the length of the front support rod is shorter than the length of the back support rod, the front support rod is arranged in an inclined way, the bottom support rod is horizontally arranged, the angle between the front support rod and the bottom support rod is an obtuse angle, the back support rod is vertically arranged, a vertical support rod is fixedly provided in the middle of the bottom support rod, the upper end of the vertical support rod is fixedly connected to the top support rod, a horizontal support rod is fixedly provided in the middle of the vertical support rod, and the back end of the horizontal support rod is fixedly connected to the back support rod.

Preferably, a lower connecting slot is provided on each lower table board, an upper connecting slot is provided on each upper table board, two connecting blocks are fixedly installed on each top support rod, the two connecting blocks are respectively inserted into the upper connecting slot and the lower connecting slot, a rectangular slot is provided on each upper table board and disposed at the back side of the upper connecting slot, a rectangular block is fixedly installed on each top support rod and disposed at the back side of the connecting block, and the rectangular blocks are inserted into the corresponding rectangular slots.

Preferably, a side guard is provided at the top of each upper table board and the bottom of each lower table board.

Preferably, two square foot pads are fixedly provided on the bottom wall of each bottom support rod.

Compared with the prior art, the present invention has the following beneficial effects:

In the present invention, firstly, each group of the upper table board and the lower table board and every two adjacent table boards are connected by latches, which makes it convenient for disassembly and assembly, when not in use, the latches can be pulled out from the latch grooves of the table boards for packing up, thereby improving the convenience of use and occupying less space for storage. Secondly, The length of the front support rod of the support frame is shorter than that of the back support rod and the front support rod is provided in an inclined way, so that the table boards form a certain angle with the ground, which is convenient for people to sit or stand in front of the jigsaw puzzle table for playing. Thirdly, each support frame further comprising a vertical support rod and a horizontal support rod, which can improve the supporting effect on the table boards as a whole, thereby improving the overall stability of the jigsaw puzzle table. Finally, the top of each upper table board and the bottom of each lower table board are provided with side guards to prevent puzzle pieces from sliding off.

DETAILED DESCRIPTION OF THE PREFERRED EMBODIMENTS

Figure 1:
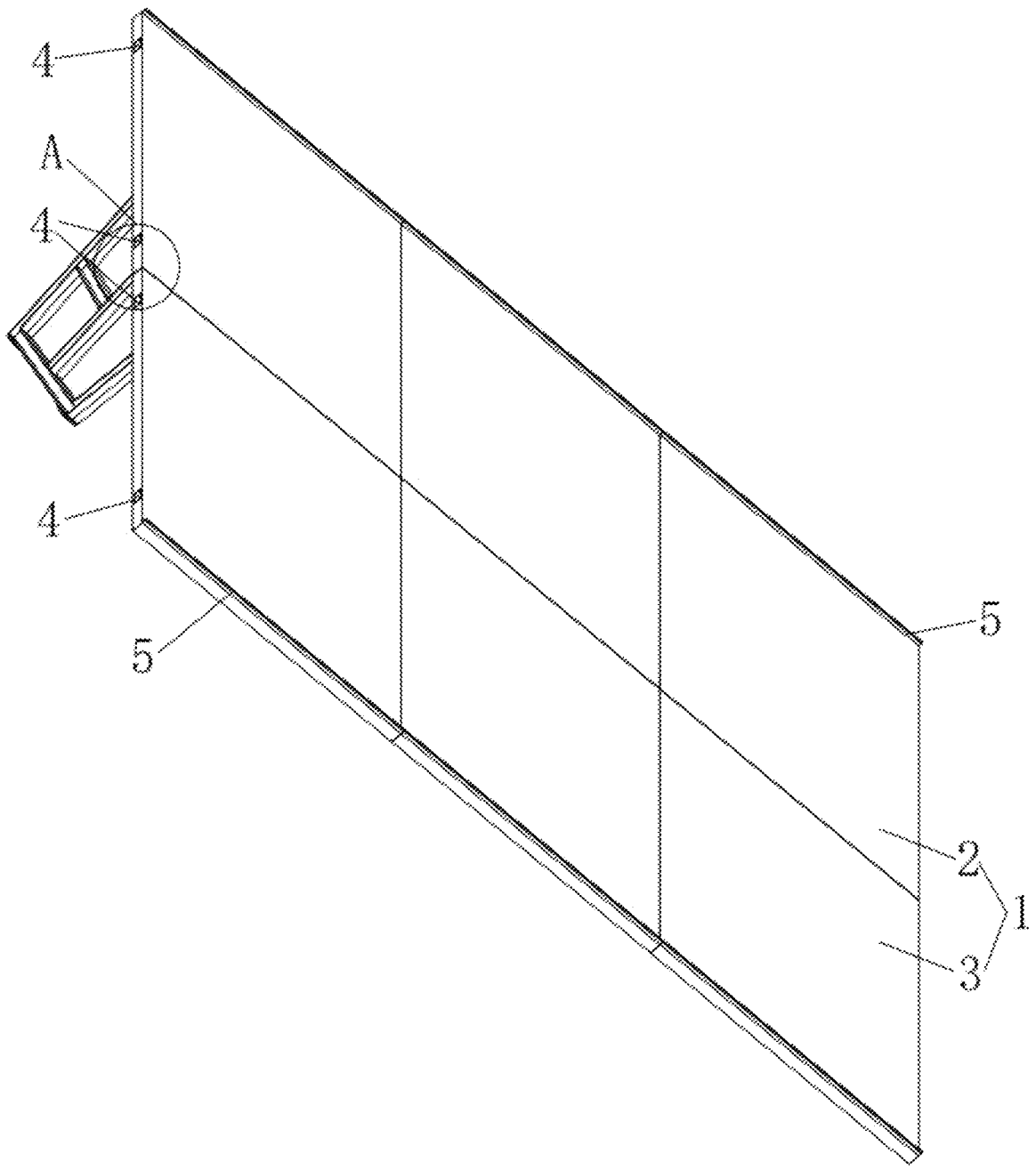
FIG. 1 is the first perspective view of the present invention.
Figure 2:
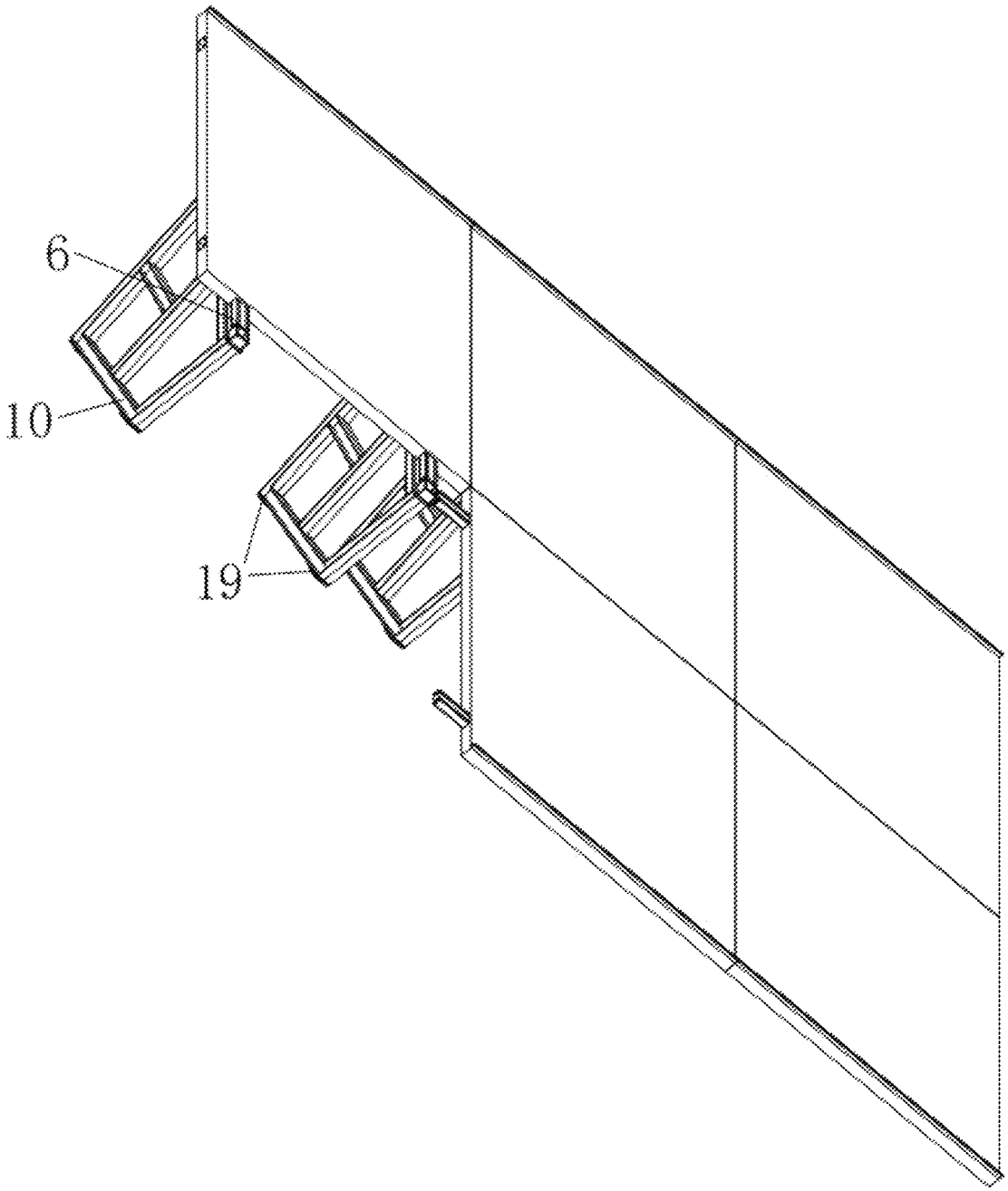
FIG. 2 is the second perspective view of the present invention.
Figure 3:
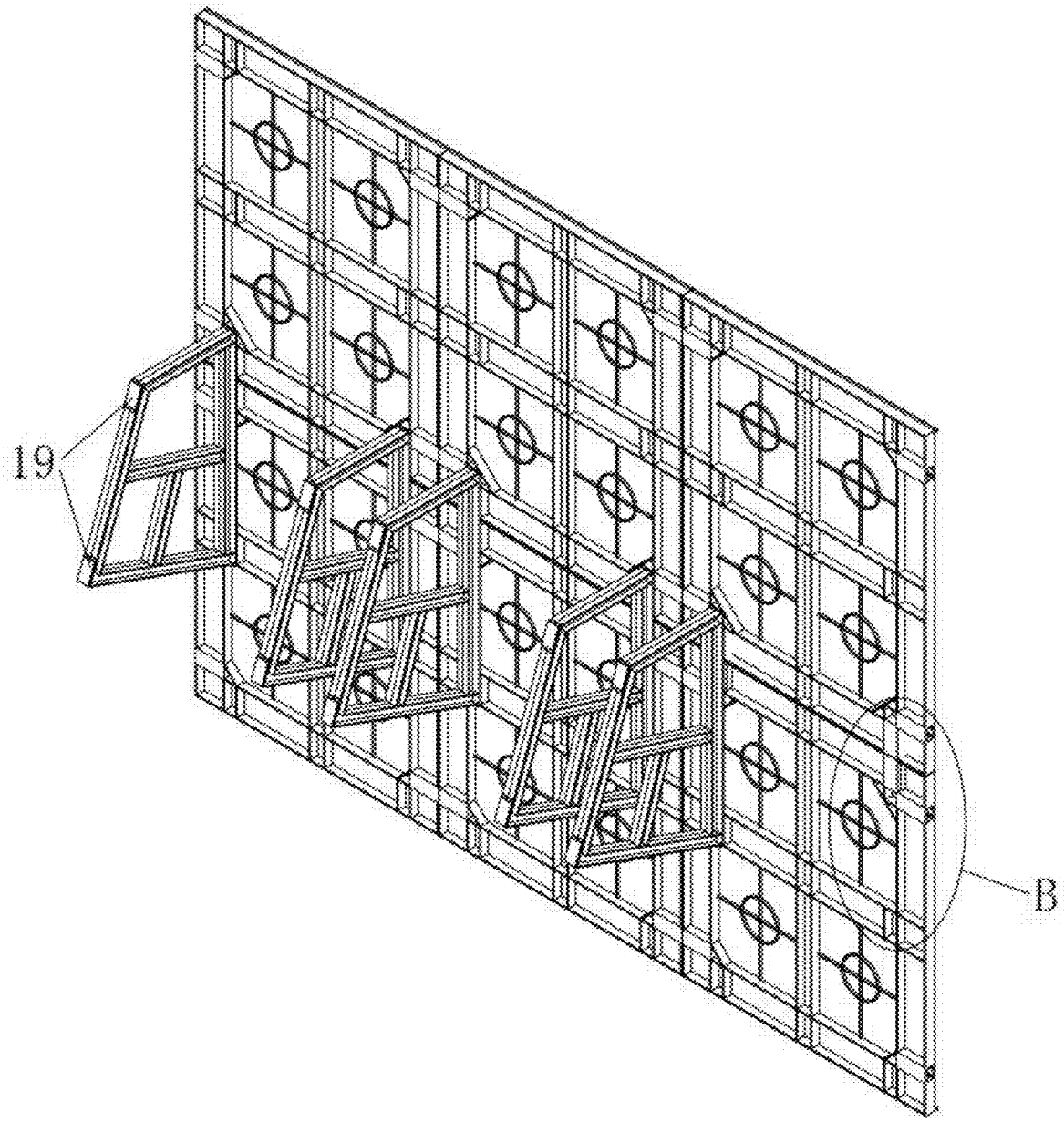
FIG. 3 is the third perspective view of the present invention.

Other features, objects and advantages of the present invention will be more clearly and completely by the detailed description of the non-limiting embodiments with reference to the attached drawings (FIG. 1 to FIG. 9). Obviously, the described embodiments are only part of the embodiments of the present invention, but not all of them. Based on the embodiments of the present invention, all other embodiments obtained by ordinary technicians in the field without creative labor are within the scope of the present invention.

A puzzle table, as shown in FIGS. 1 to 9, comprising three groups of table boards 1, each group of the table boards 1 includes an upper table board 2 and a lower table board 3;

the left, right and bottom sides of the upper table boards 2 are all provided with latch grooves 4, the left, right and upper sides of the lower table boards 3 are all provided with latch grooves 4, a latch 6 is disposed in every two opposite latch grooves 4, a limiting block 7 is fixedly connected in each latch groove 4, two limiting grooves 8 are provided on the top of each latch 6, a plurality of concave grooves 9 are evenly provided on the bottom of each latch 6, two support frames 10 are installed on the bottom of each group of the upper table board 2 and the lower table board 3, and each support frame 10 is provided in an irregular quadrilateral structure.

The support frame 10 includes four support rods 11, the four support rods 11 are connected end-to-end in sequence to form an irregular quadrilateral frame, the length of the front support rod 11 is shorter than that of the back support rod 11, the front support rod 11 is arranged in an inclined way, the bottom support rod 11 is horizontally arranged, the angle between the front support rod 11 and the bottom support rod 11 is an obtuse angle, the back support rod 11 is vertically arranged, a vertical support rod 12 is fixedly provided in the middle of the bottom support rod 11, the upper end of the vertical support rod 12 is fixedly connected to the top support rod 11, a horizontal support rod 13 is fixedly provided in the middle of the vertical support rod 12, and the back end of the horizontal support rod 13 is fixedly connected to the back support rod 11.

A lower connecting slot 14 is provided on each lower table board 3, an upper connecting slot 15 is provided on each upper table board 2, two connecting blocks 16 are fixedly installed on each top support rod 11, the two connecting blocks 16 are respectively inserted into the upper connecting slot 15 and the lower connecting slot 14, a rectangular slot 17 is provided on each upper table board 2 and disposed at the back side of the upper connecting slot 15, a rectangular block 18 is fixedly installed on each top support rod 11 and disposed at the back side of the connecting block 16, and the rectangular blocks 18 are inserted into the corresponding rectangular slots 17.

A side guard 5 is provided at the top of each upper table board 2 and the bottom of each lower table board 3.

Two square foot pads 19 are fixedly provided on the bottom wall of each bottom support rod 11.

Figure 4:
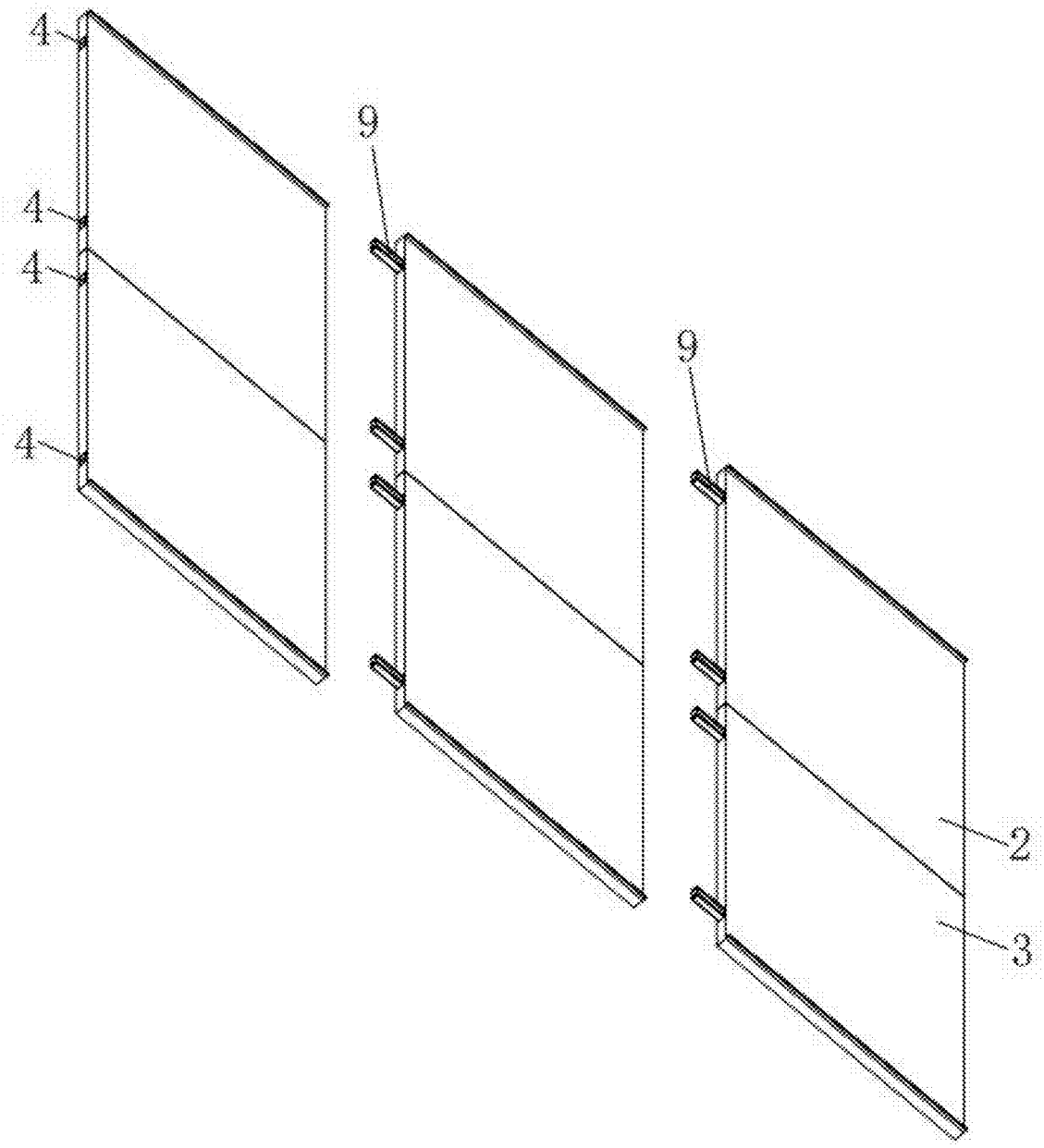
FIG. 4 is a perspective view of the splicing structure of a table board in the present invention.
Figure 5:
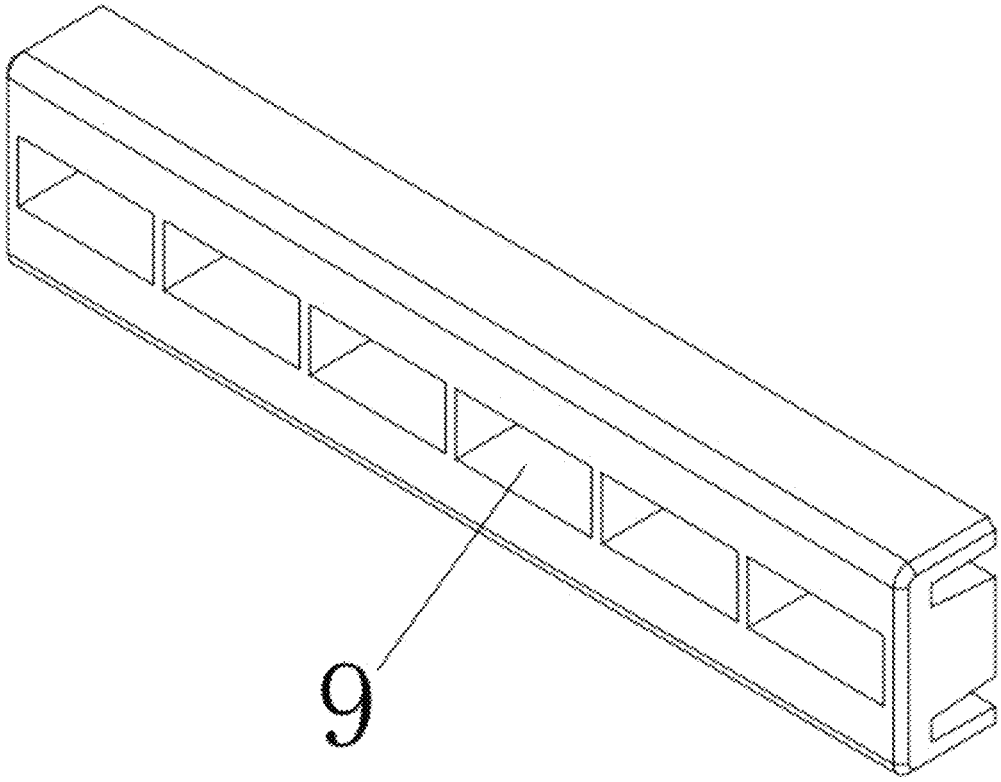
FIG. 5 is the first perspective view of a latch in the present invention.
Figure 6:
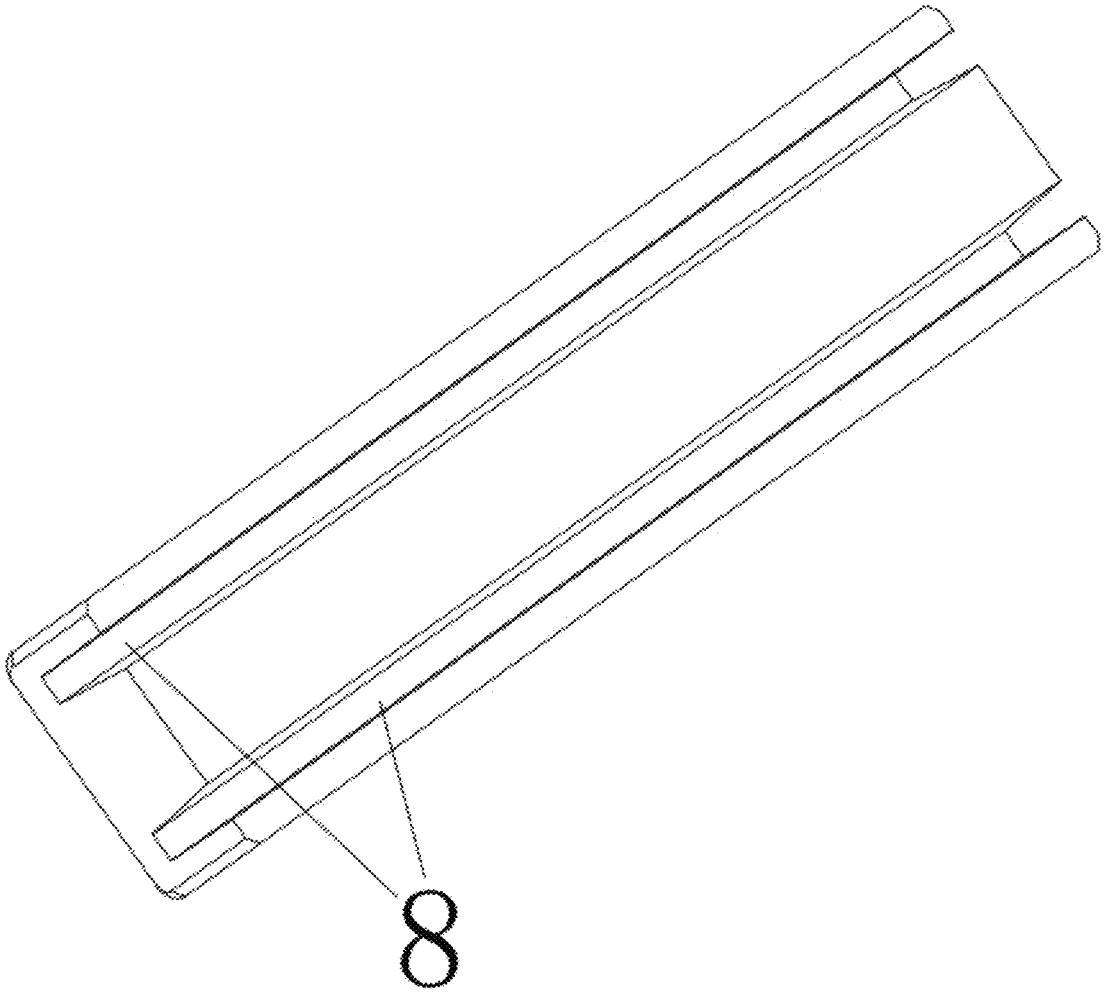
FIG. 6 is the second perspective view of a latch in the present invention.
Figure 7:
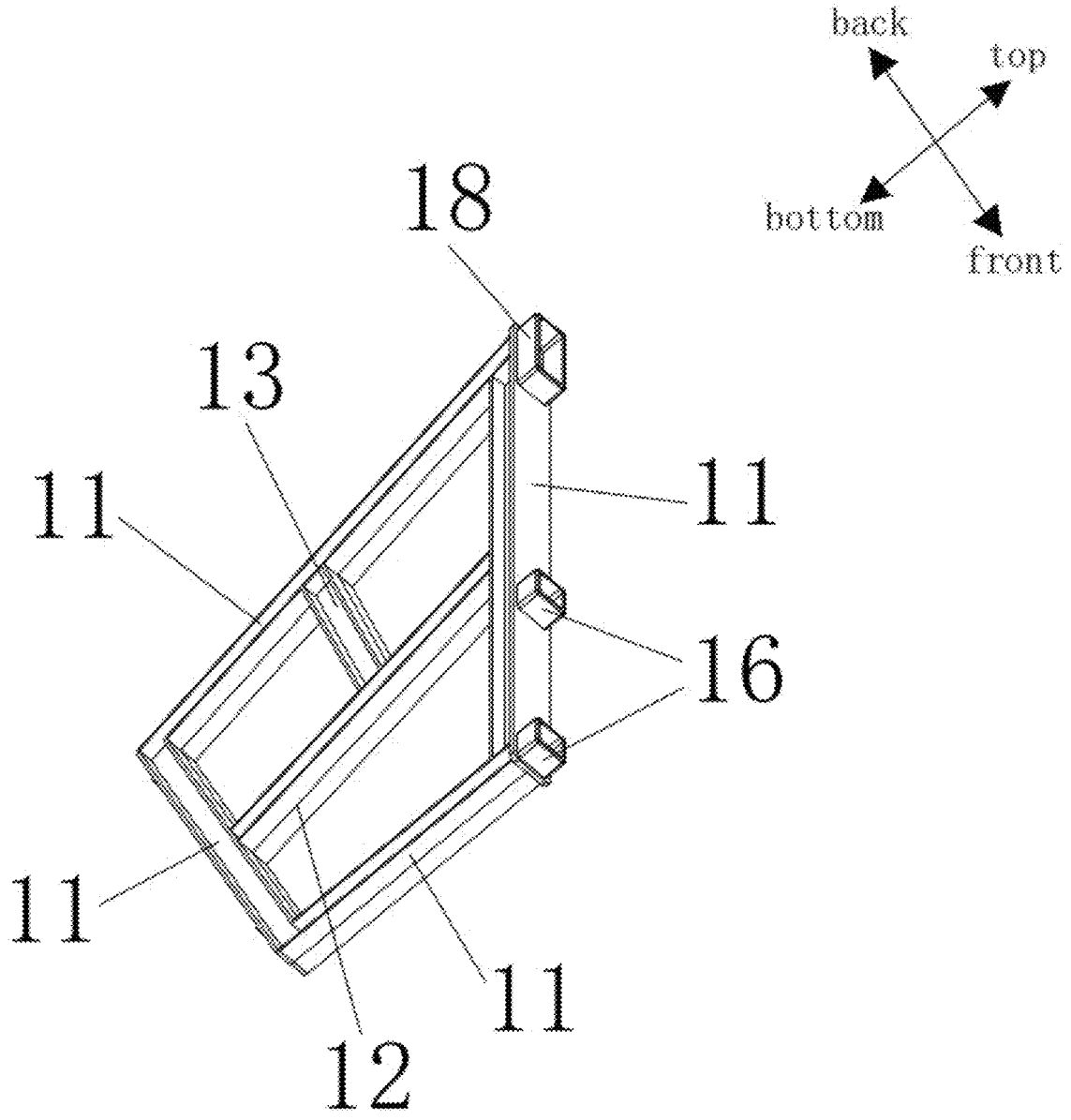
FIG. 7 is a perspective view of a support frame in the present invention.
Figure 8:
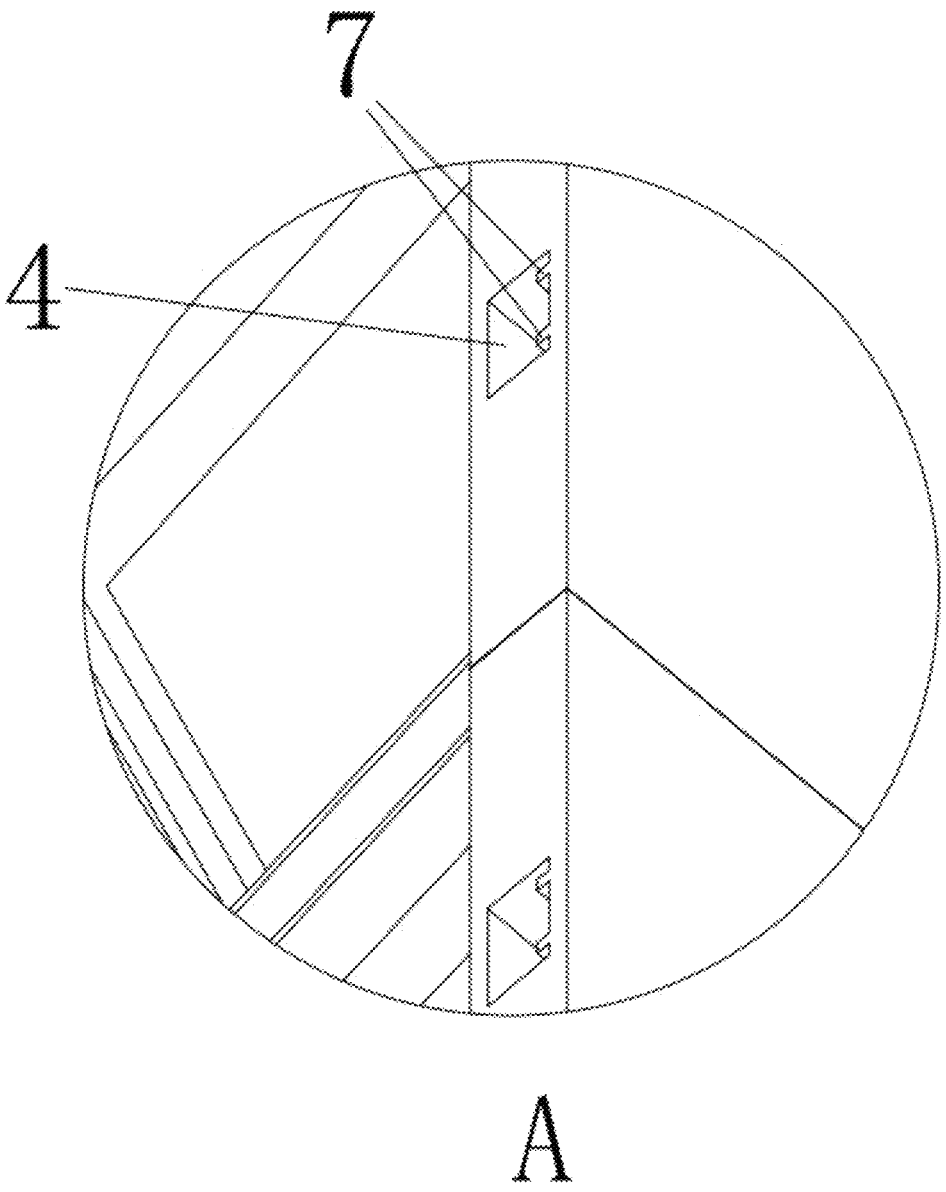
FIG. 8 is an enlarged schematic view of point A in FIG. 1.
Figure 9:
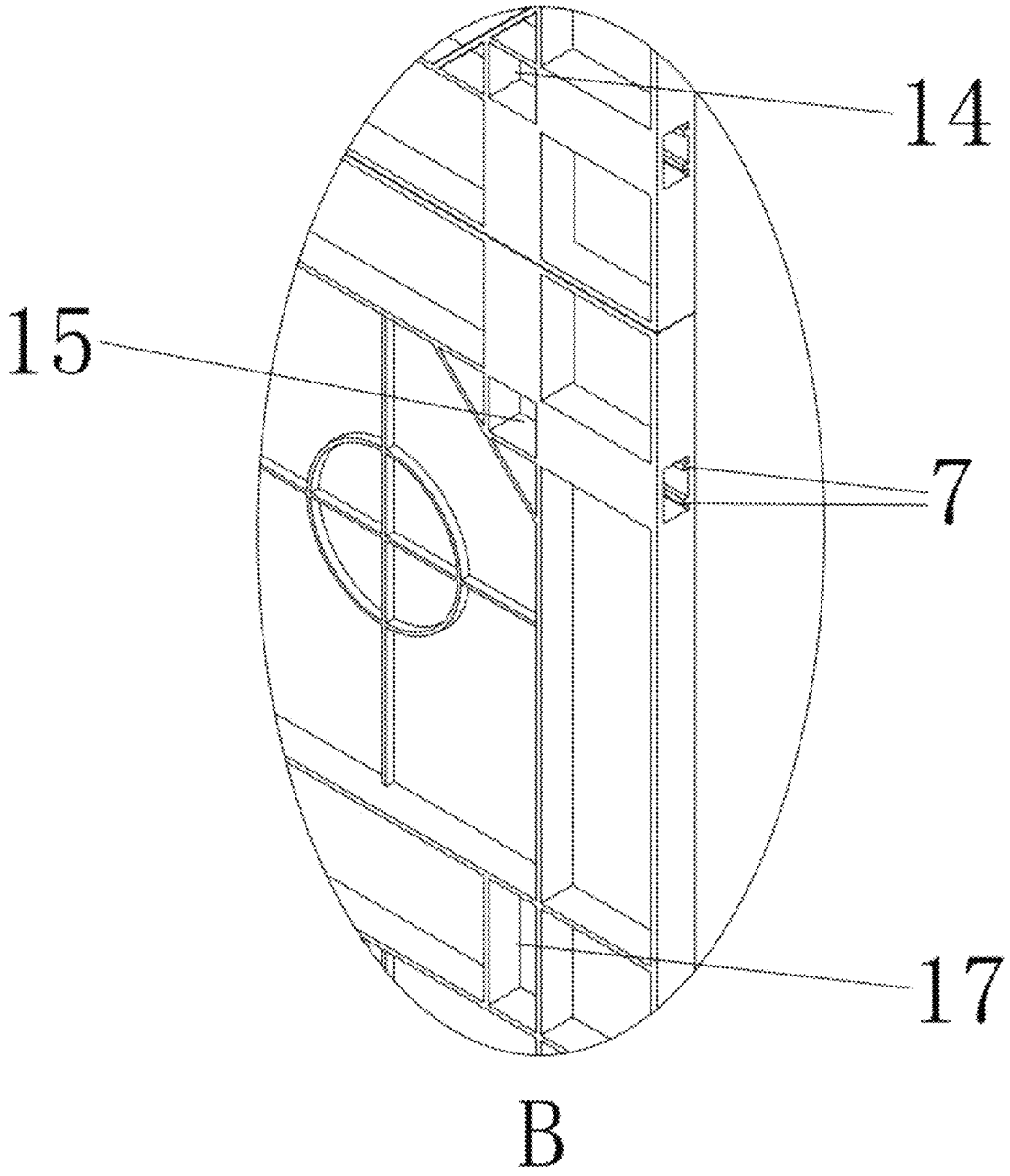
FIG. 9 is an enlarged schematic view of point B in FIG. 3.

During use, firstly, fit a group of table boards 1 (i.e., an upper table board 2 and a lower table board 3) together, one end of the latches 6 are inserted into the latch grooves 4 of an upper table board 2, and then the other end of the latches 6 are inserted into the latch grooves 4 of a lower table board 3, in this way, the assembly of a group of table boards 1 is completed, and the state shown in FIG. 4 is obtained after three groups of table boards 1 are assembled; secondly, the latches 6 are inserted into the four latch grooves 4 on the same side of one group of table boards 1, and then the other end of the latches 6 are inserted into the latch grooves 4 corresponding to the other group of table boards 1, and the state shown in FIG. 1 is obtained after assembled; finally, the two connecting blocks 16 and the rectangular block 18 on the each top support rod 11 are inserted into the lower connecting slot 14 on the lower table board 3 and the upper connecting slot 15 and the rectangular groove 17 on the upper table board 2, in order to achieve the installation of the support frame 10.

In the present invention, firstly, the length of the front support rod 11 in the support frame 10 is shorter than the length of the back support rod 11 and the front support rod 11 is provided in an inclined way, so that the table boards 1 form a certain angle with the ground, which is convenient for people to sit or stand in front of the jigsaw puzzle table for playing. Secondly, the top of each upper table board 2 and the bottom of each lower table board 3 are provided with side guards 5 to prevent puzzle pieces from sliding off. Thirdly, each support frame 10 further comprising a vertical support rod 12 and a horizontal support rod 13, which can improve the supporting effect on the table boards 1 as a whole, thereby improving the overall stability of the jigsaw puzzle table. Finally, when not in use, just remove the support frames 10 from the bottom of the table boards 1, and then separate the upper table boards 2 and the lower table boards 3, which is convenient for disassembly and occupies less space.

In the present invention, the use of orientation words such as "front", "back", "up", "bottom", etc. are only for the convenience of description, rather than indicating or implying the specific orientation, therefore it should not be construed as being limited to the description of the following embodiments. In addition, it should be noted that the terms "first", "second" and the like in the description and claims of the present invention and the above drawings are used to distinguish similar objects, which are not necessarily used to describe the specific order or sequence. It is to be understood that the data so used are interchangeable under appropriate circumstances in order to describe the embodiments of the invention herein.

Unless otherwise stated, it should be noted that the terms "provided", "installed" and "connected" should be understood broadly. For example, "connected" could be fixed connection, detachable connection, integral connection, mechanical connection, electrical connection, direct connection, indirect connection through the intermediate structure, or internal connection between two elements. For those of ordinary skill in this field, the specific meanings of the above terms in the present invention can be understood in specific situations.

Hereinafter, embodiments of the present invention has been described in detail with reference to the accompanying drawings. While the description above refers to the particular embodiments of the present invention, it will be understood that many modifications may be made without departing from the spirit thereof. Any equivalent replacement or modification would fall within the protection scope of the present invention.

What is claimed is:

1. A jigsaw puzzle table, comprising three groups of table boards (1), each group of the table boards (1) including an upper table board (2) and a lower table board (3); the left, right and bottom sides of the upper table boards (2) are all provided with latch grooves (4), the left, right and upper sides of the lower table boards (3) are all provided with latch grooves (4), a latch (6) is disposed in every two opposite latch grooves (4), a limiting block (7) is fixedly connected in each latch groove (4), two limiting grooves (8) are provided on the top of each latch (6), a plurality of concave grooves (9) are evenly provided on the bottom of each latch (6), one or more support frames (10) are installed on a bottom portion of each of the upper table board (2) and the lower table board (3), and each support frame (10) is provided in an irregular quadrilateral structure.

2. The jigsaw puzzle table according to claim 1, the support frame (10) further comprising four support rods (11), the four support rods (11) are connected end-to-end in sequence to form an irregular quadrilateral frame, the length of the front support rod (11) is shorter than the length of the back support rod (11), the front support rod (11) is arranged in an inclined way, the bottom support rod (11) is horizontally arranged, the angle between the front support rod (11) and the bottom support rod (11) is an obtuse angle, the back support rod (11) is vertically arranged, a vertical support rod (12) is fixedly provided in the middle of the bottom support rod (11), the upper end of the vertical support rod (12) is fixedly connected to the top support rod (11), a horizontal support rod (13) is fixedly provided in the middle of the vertical support rod (12), and the back end of the horizontal support rod (13) is fixedly connected to the back support rod (11).

3. The jigsaw puzzle table according to claim 2, wherein a lower connecting slot (14) is provided on each lower table board (3), an upper connecting slot (15) is provided on each upper table board (2), two connecting blocks (16) are fixedly installed on each top support rod (11), the two connecting blocks (16) are respectively inserted into the upper connecting slot (15) and the lower connecting slot (14), a rectangular slot (17) is provided on each upper table board (2) and disposed at the back side of the upper connecting slot (15), a rectangular block (18) is fixedly installed on each top support rod (11) and disposed at the back side of the connecting block (16), and the rectangular blocks (18) are inserted into the rectangular slots (17).

4. The jigsaw puzzle table according to claim 2, wherein a side guard (5) is provided at the top of each upper table board (2) and the bottom of each lower table board (3).

5. The jigsaw puzzle table according to claim 2, wherein two square foot pads (19) are fixedly provided on the bottom wall of each bottom support rod (11).

* * * * *